United States Patent [19]

Warrington

[11] Patent Number: 4,819,740

[45] Date of Patent: Apr. 11, 1989

[54] VIBRATORY HAMMER/EXTRACTOR

[75] Inventor: Don C. Warrington, Cleveland, Tenn.

[73] Assignee: Vulcan Iron Works Inc., Chattanooga, Tenn.

[21] Appl. No.: 121,666

[22] Filed: Nov. 16, 1987

[51] Int. Cl.[4] ..... E02D 7/18

[52] U.S. Cl. ..... 173/49; 173/162.1

[58] Field of Search ..... 173/49, 162.1; 175/55, 175/56; 74/61

[56] References Cited

U.S. PATENT DOCUMENTS

| | | | |
|---|---|---|---|
| 3,287,983 | 11/1966 | Austin et al. | 74/61 |
| 4,113,034 | 9/1978 | Carlson | 173/49 |
| 4,625,811 | 12/1986 | Tuenkers | 173/49 |

*Primary Examiner*—Frank T. Yost
*Assistant Examiner*—James L. Wolfe
*Attorney, Agent, or Firm*—Mason, Kolehmainen, Rathburn & Wyss

[57] ABSTRACT

A vibratory hammer/extractor for use with elongated pilings and the like extended into the earth includes a clamping assembly for releasing and securing the hammer to an upper end portion of a piling extended into the ground. A vibratory exciter is mounted on the clamping assembly for generating vibratory forces to be imparted to the piling while clamped tightly, and a suspension device is provided for supporting the exciter and isolating the vibration thereof from a hammer supporting element such as a flexible cable extending downwardly from the boom of a crane. The vibratory exciter includes a hollow gear case having a lower end wall secured to the clamping assembly and at least one pair of eccentric weights mounted on shafts for rotation about an axis transversely of the clamped piling for imparting vibratory forces to the piling as the eccentrics are driven in rotation. Each eccentric comprises a unitary body of dense material such as steel plate having a generally circular periphery and coaxially mounted to rotate with a supporting shaft. Each eccentric body is formed with an enlarged opening or slot on one side of the shaft between a central shaft hub and an outer rim adjacent the periphery. The removal of material to form the slot creates an eccentric center of gravity on the opposite side of the shaft away from the slot. The exciter includes a rotary power unit such as a hydraulic motor mounted on the gear case for rotating a drive shaft carrying one of the eccentrics and the other eccentric is driven by intermeshing toothed engagement with the one eccentric to rotate in an opposite direction.

16 Claims, 3 Drawing Sheets

VIBRATORY HAMMER/EXTRACTOR

BACKGROUND OF THE INVENTION

1. Field of the Invention

The present invention relates to a new and improved vibratory hammer/extractor for use with elongated pilings and the like which are extended into the earth. More particularly, the invention relates to a vibratory exciter which is mounted on a clamping assembly for generating vibrating forces to be imparted to a piling member while clamped by the assembly and extended into the earth. In theory, vibratory-type hammer/extractors are used for driving or extracting elongated piling members by vibratory forces imparted to the upper portion. These forces are transmitted down the piling into the surrounding earth and the piling can then move downwardly under the weight of the piling and the hammer without requiring an impact blow from a dropping hammer element.

2. Field of the Prior Art

Vibratory-type hammer/extractors have been utilized for driving and extracting elongated pilings, shoring members, etc., and these hammer/extractors differ from conventional impact type devices in that vibratory forces are applied to an upper end portion of the piling which is then able to move up or down in the earth because of the vibrating action imparted to the earth itself surrounding the piling. Such vibratory hammer-/extractors are much more desirable for use in congested areas because spike like shock wave patterns are greatly reduced and high level noises are minimized.

OBJECTS OF THE INVENTION

It is an object of the invention to provide a new and improved vibratory hammer/extractor of the character described and more particularly one which employs a novel vibratory exciter mounted between a clamping assembly and a suspension device thereof.

More particularly, an object of the invention is to provide a new and improved vibratory hammer/extractor which employs a novel vibratory exciter mechanism having at least one pair of gear like eccentrics mounted for rotation within a hollow case so as to generate a selectively controllable amount of vibratory action that is transmitted to an upper end portion of a piling to which the hammer/extractor is clamped.

Yet another object of the present invention is to provide a new and improved vibratory hammer/extractor of the character described which has a simplified construction and thus enables the hammer to achieve improved performance in the coupling of vibratory energy to an elongated piling in the earth.

Yet another object of the present invention is to provide a new and improved vibratory hammer/extractor wherein at least one of a pair of rotary eccentrics in the vibratory exciter is formed from a unitary piece of heavy material such as steel plate having an eccentric center of gravity that is found by the removal of material on one side of a rotary shaft supporting the eccentric.

Another object of the invention is to provide a new and improved vibratory hammer/extractor which does not require the use of a separate eccentric weights mounted on a rotating member carried by a shaft.

Still another object of the present invention is to provide a new and improved vibratory exciter of the character described having a relatively lightweight enclosure or casing surrounding a pair of rotary eccentrics thus providing a lower weight overall so that vibratory energy produced as the eccentrics rotate is more efficiently coupled to the piling to be driven or extracted.

Yet another object of the present invention is to provide a new and improved vibratory hammer/extractor employing an exciter having a plurality of intermeshing rotatively driven eccentrics carried in an enclosed hollow casing and rotatable at a selected speed to impart the desired amount of vibratory force to a piling clamped thereto.

Another object of the present invention is to provide a new and improved vibratory hammer/extractor of the character described which is simple of construction, foolproof in operation and especially effective and efficient in transferring or coupling of vibratory energy to a piling member clamped thereby for driving or extracting the piling to or from the earth.

BRIEF SUMMARY OF THE INVENTION

In accordance with the present invention, a new and improved vibratory hammer/extractor is provided for use with elongated pilings and the like extending into the earth. The hammer/extractor includes a lower clamping assembly operable for releasing and securing the hammer to an upper end portion of the piling for driving or extracting the same to or from the earth. A vibratory exciter is attached to the clamping assembly for generating vibratory forces of a controlled nature which are imparted to the piling. A suspension and isolation device is provided for supporting the exciter, clamping assembly and the piling in a manner so as to isolate the vibration thereof from a hammer supporting element such as an elongated flexible cable or the like extending downwardly from the boom of a crane. The novel exciter of the vibratory hammer/extractor includes a relatively light in weight, hollow gear case having a lower end wall secured directly to the clamping assembly and the case contains at least one pair of rotating intermeshing eccentrics carried on shafts mounted in the case for rotation about axes extending transversely of a clamped piling. Each eccentric comprises a unitary body of dense material such as steel plate having a generally circular periphery and a hub coaxially mounted on a supporting shaft. The body of each eccentric is formed with a slot on one side of the shaft between the hub and an outer rim portion adjacent the periphery. The removal of body material to form the slot creates an eccentric center of gravity on an opposite side of the shaft away the slot so that when the shaft is rotated, vibrating forces are generated and coupled to the piling with a minimum of dampening effect. The exciter is provided with a power unit such as a hydraulically powered motor mounted on the case for direct coupling to one of the shafts.

BRIEF DESCRIPTION OF THE DRAWINGS

For a better understanding of the present invention, reference should be had to the following detailed drawings taken in conjunction with the drawings, in which.

DETAILED DESCRIPTION OF A PREFERRED EMBODIMENT

Figure 1:
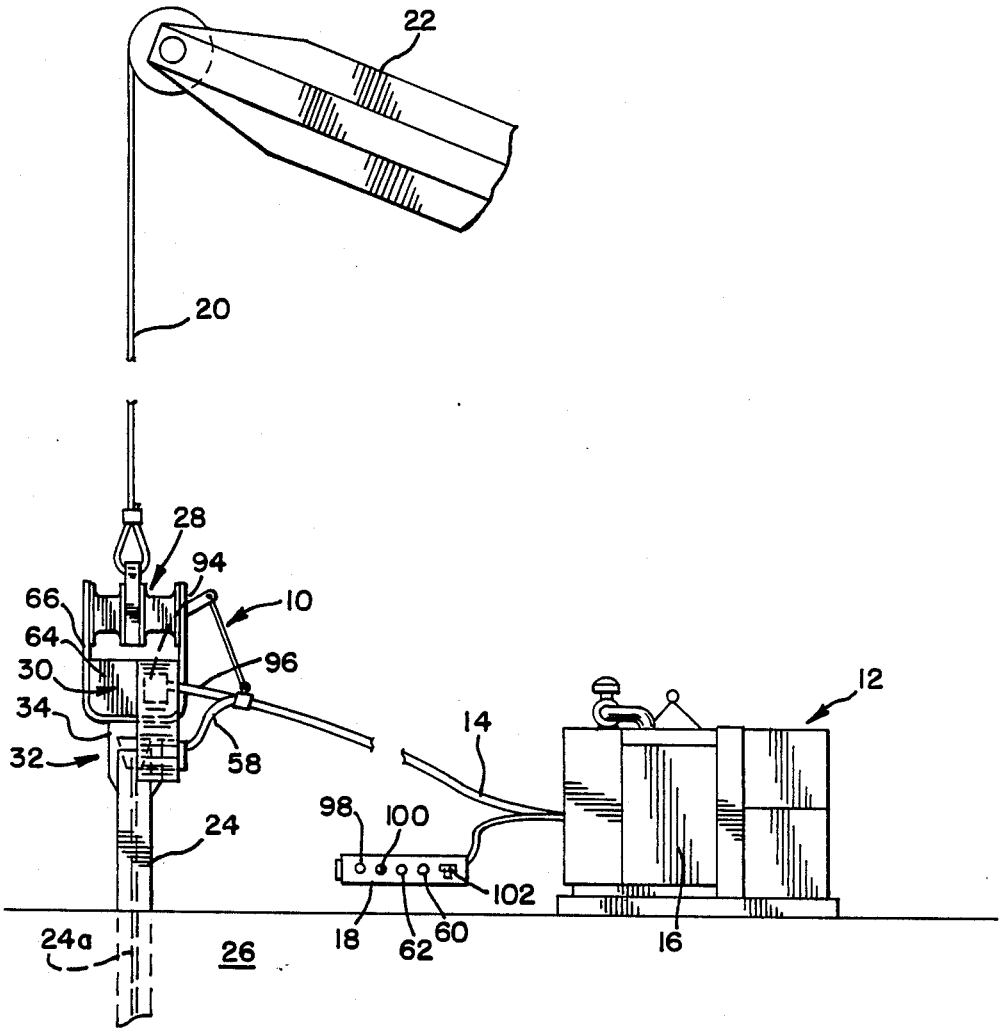
FIG. 1 is an elevational view of a new and improved vibratory hammer/extractor constructed in accordance with the features of the present invention.

Referring now more particularly to the drawings, therein is illustrated a new and improved vibratory hammer/extractor constructed in accordance with the features of the present invention and generally referred to by the reference numeral 10. Power is supplied to operate the vibratory hammer/extractor 10 from a remote power pack 12 interconnected with the hammer-/extractor via a bundle of hydraulic and pneumatic lines 14 as illustrated best in FIGS. 1 and 2. Preferably the power pack 12 includes a motive power unit such as a diesel engine 16 drivingly interconnected with an air compressor and a hydraulic pump (not shown) in order to provide both hydraulic fluid power and pneumatic control for the vibratory hammer/extractor 10 through the bundle of lines 14.

A portable remote control box 18 is connected to the power pack 12 to enable a hammer operator to control the operation of the hammer/extractor from different positions. In normal usage, the vibratory hammer/extractor is supported from above through an elongated flexible cable 20 extending downwardly from the boom of a crane 22 or gin pole, and the vibratory hammer/extractor 10 is detachably clamped to the upper end portion of an elongated piling or shoring member 24 extending into the earth 26 as illustrated in FIG. 1.

In accordance with the present invention, the vibratory hammer/extractor 10 includes an upper vibration isolating support element 28 joined to an intermediate level vibratory exciter 40 secured at the lower end to a pile clamping assembly 32 for detachably clamping the hammer/extractor to an upper end portion of a web **24*a* (FIG. 2) of an elongated piling or shoring member 24**.

Clamping Assembly

The pile clamping assembly 32 includes a downwardly opening, generally U-shaped clamp housing 34, preferably formed of cast steel and comprises a pair of downwardly extending legs or clamp support elements 36 and 38 that are spaced apart to define an upwardly extending open throat 40 for receiving the upper end portion of the web **24*a* of an elongated piling or shoring member 24. At the upper end, the clamp housing includes a cross member or bight portion 42 and an upper base plate 44 which is detachably secured to the vibratory exciter 30 by a plurality of upwardly extending threaded cap screws 46**.

A pair of replaceable jaws 48 and 50 are mounted on the legs of the clamp housing on opposite sides of the throat 40 for gripping the web **24*a* and the jaw 48 is adapted to be fixedly secured in position on the longer leg 36 of the clamp housing by a plurality of cap screws 52. The opposite jaw 50 is secured to a piston rod 54*a* of a hydraulic clamping cylinder 54 adapted to move the jaw 50 into and out of clamping engagement with the web 24 of the piling member. A forward end of the clamping cylinder 54 is secured to the short leg 38 of the clamp housing 34 by a plurality of cap screws 56 as shown in FIG. 2**.

Hydraulic fluid is supplied to operate the clamping cylinder 54 through fittings at opposite ends of the cylinder and a pair of flexible hydraulic lines 58 contained in the bundle of lines 14 are connected to the hydraulic system of the power pack 12 in a manner well known in the art. Clamping and unclamping of the movable jaw 50 is controlled through the remote control box 18 which is provided with a "CLAMP" pushbutton 60 and an "UNCLAMP" pushbutton 62.

Vibratory Exciter

Figure 3:
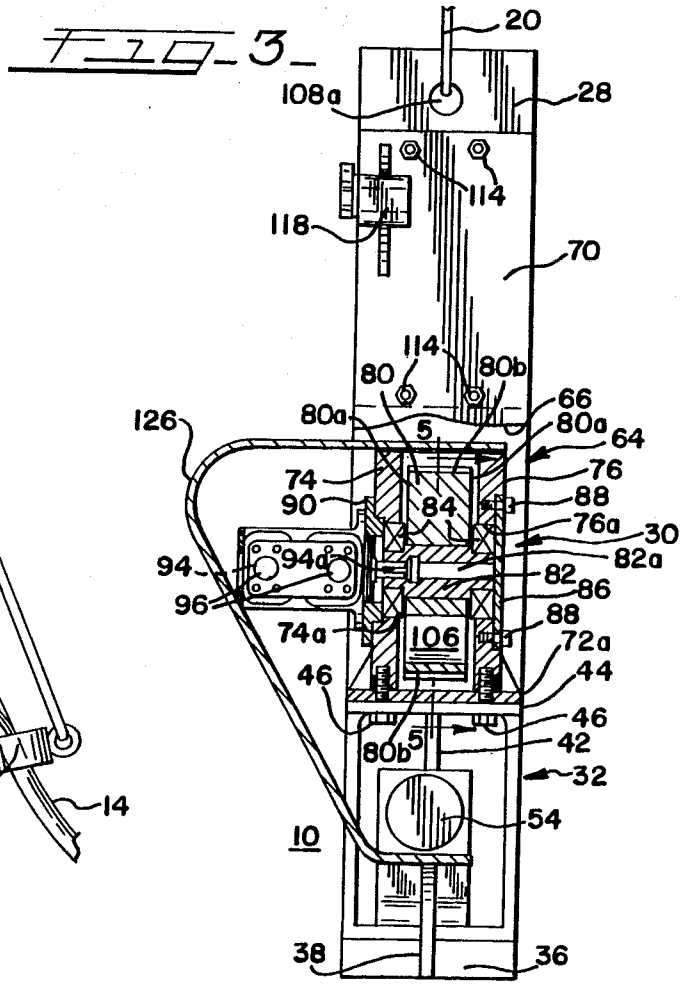
FIG. 3 is an end elevational view (with portions broken away and in section) taken substantially along lines 3—3 of FIG. 2.
Figure 2:
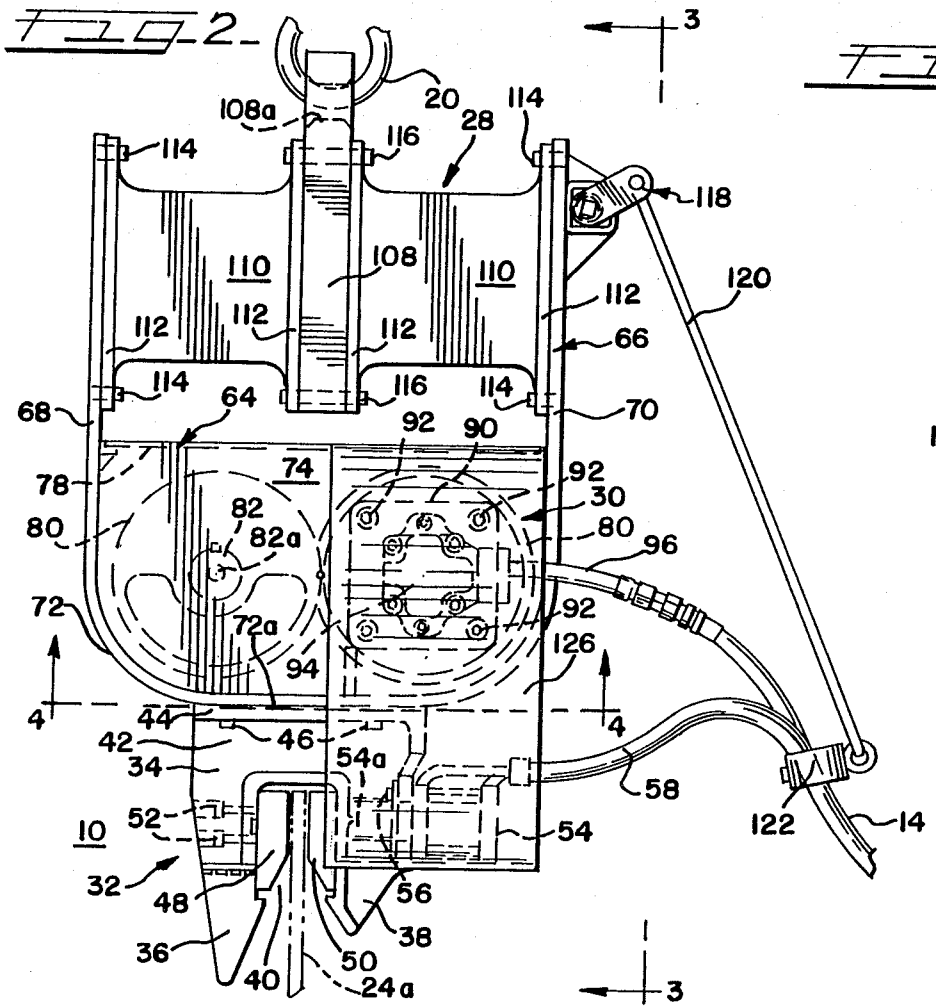
FIG. 2 is an enlarged side elevational view of the vibratory hammer/extractor.
Figure 4:
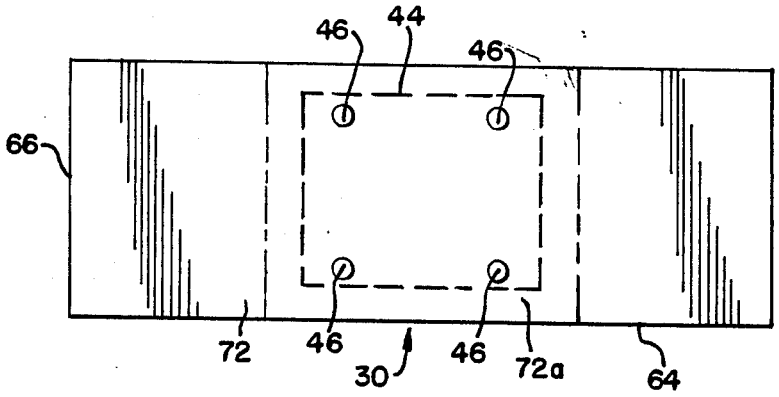
FIG. 4 is a horizontal transverse cross-sectional view taken substantially along lines 4—4 of FIG. 2.

In accordance with the present invention, the vibratory exciter 30 includes a hollow gear case 64 formed by a U-shaped end wall member 66 of relatively thin metal having a pair of upstanding, spaced apart legs 68 and 70 joined by a lower bight portion 72 having a flat central segment **72*a* in direct contact with the upper base plate 44 of the clamping assembly as best shown in FIGS. 2 and 3. The gear case also includes a pair of opposite, spaced apart, relatively thick side plates 74 and 76 joined to the inside surfaces of the U-shaped member 66 by welding as illustrated in FIG. 3 to form a liquid or grease tight container. The case also includes a flat top wall 78 extending between the legs 68 and 70 at a level intermediate their length (as shown in FIG. 2**) to complete the enclosure.

In accordance with the present invention, the hollow gear case 64 encloses at least one of a pair of rotating eccentrics 80, each of which is mounted on and keyed to rotate with a short hollow shaft 82 having opposite ends supported in heavy-duty bearings 84. The bearings are seated in pairs of circular openings **74*a* and 76*a* provided in the thick side plates 74 and 76, respectively. As illustrated best in FIG. 3, the side plate 76 is formed with a pair of large, circular, outer recesses in concentric alignment with the openings 76*a* in order to receive circular closure plates 86** secured to enclose the outer end of the shafts and the bearings. A plurality of cap screws are provided to secure the closure plates to the thick walled side plates.

A single closure plate 86 is provided on the opposite side plate or wall 74 for only one of the shafts 82 (idler shaft) and the other (driven) shaft 82 is encircled by an annular mounting ring 90 secured in place by cap screws 92 (FIG. 2). The ring 90 serves as a closure plate around the driven shaft and as a mounting base for a flanged-end type, hydraulic motor 94. The hydraulic motor is supplied with hydraulic fluid via pressure and return lines 96 extending from the bundle of lines 14 and the motor may be driven to rotate at selected speeds depending on which of the lines 96 is supplied with pressurized fluid and which line provides for fluid return.

The hydraulic motor 94 includes an output shaft **94*a* which is keyed in a direct drive relation with the keyed interior hollow end portion of the driven shaft 82. Accordingly, when pressurized hydraulic fluid is supplied to the motor 84 from the power pack 12, the eccentric 80 (right hand, FIG. 2) is driven to rotate at a speed determined by the flow rate of hydraulic fluid that is supplied. Control of the hydraulic fluid flow and the rate thereof to and from the hydraulic motor 94 is provided at the remote control 18 by means of start and stop pushbuttons 98 and 100 and a throttle control 102 for controlling the power supplied by the diesel engine 16. In order to protect the hydraulic motor 94 from inadvertent damage, a motor guard 126** is provided to shelter the motor casing.

Figure 5:
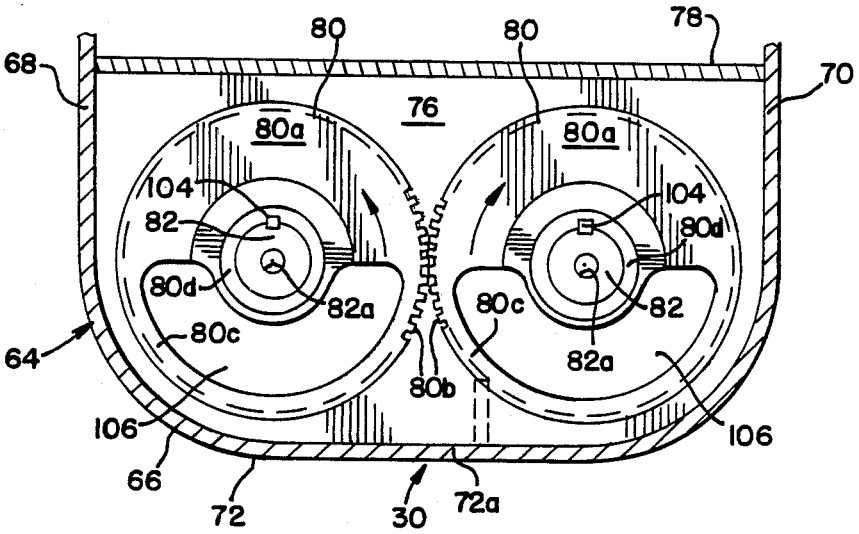
FIG. 5 is a fragmentary cross-sectional view taken substantially along lines 5—5 of FIG. 3.

In accordance with an important feature of the present invention, the hollow gear case 64 is dimensioned to accommodate a pair of horizontally spaced apart rotary eccentrics 80 which are driven by a single hydraulic motor 94. The eccentrics are continuously bathed in a supply of lubricating oil or grease contained within the interior of the case 64. Each eccentric is formed out of a relatively thick, unitary, heavy piece of steel plate and is of a generally cylindrical shape having flat, parallel, opposite sides 80*a* and a cylindrical ring of teeth 80*b* provided around the periphery of the cylinder. The teeth of the eccentrics are continuously intermeshing to rotate the eccentrics in opposite directions as indicated by the arrows in FIG. 5.

Each cylindrical eccentric includes an outer rim portion 80*c* supporting and adjacent to the peripheral ring of teeth and an annular, inner rim or hub 80*d* keyed to the shaft 82 by means of a key 104. As illustrated in FIG. 3, the opposite side faces 80*a* of each eccentric 80 are spaced only a short distance away from the adjacent inside surfaces of the side plates 74 and 76 so that the rotary eccentric weights 80 occupy a majority of the internal volume provided within the gear case 64.

In accordance with the present invention, the eccentricity of each rotating member 80 is provided by forming a large slotted out segment 106 or bean-shaped hollow space between the hub and rim on one side of a diametrical radial line extending outwardly from the central shaft 82. The slots 106 are formed by cutting completely through the thickness of the eccentrics 80 from one side face 80*a* to an opposite side face 80*a*, and the removal of the material in forming the slot shifts the center of gravity of the rotating body 80 to an opposite side of the central shaft or center line. The amount of material removed determines the amount of the "eccentric moment" that is provided, and when an eccentric 80 is then rotated, a sinusoidal vibrating force is developed and is coupled to the upper end portion of a clamped piling web 24*a*. The vibratory forces developed by the rotating eccentric 80 are transferred to the piling 24 through the shafts 82, the heavy duty ring bearings 84 and the bottom wall 72*a* and side plates 74 and 76 of the gear case 64 attached to the clamping assembly 32.

Because of the relatively large thickness of the side plates 74 and 76, the cap screws 46 which hold the lower clamping assembly 32 in place are extended directly upwardly into threaded apertures provided in the side plates and this results in a firm and secure connection between the case 64 of the exciter 30 and the clamping assembly 32 which is capable of withstanding and transmitting a high value of vibratory force input from the eccentrics 80 to the piling 24. The amount of the eccentric moment provided by a rotating eccentric 80 may be reduced by reducing the slot size of the open slot 106 that is cut from the body of material when fabricating the eccentric. If a greater value of vibratory force is desired, in addition to a single pair of eccentrics as illustrated, additional pairs of eccentrics can be provided spaced upwardly in an upwardly enlarged gear case 64. These additional pairs of eccentrics are drivingly intermeshed with the gear teeth 80*b* of the lower pair of eccentrics 80. It will also be seen from FIG. 3 that the intermeshing gear teeth 80*b* extend across substantially the entire width of the interior of the gear case 64 between the faces 80*a* of the eccentrics 80 to provide a maximum length of driving contact between the teeth of the intermeshing eccentrics 80. This results in a lower tooth loading and longer gear life.

Isolation Support Assembly

In accordance with the present invention, the new and improved vibratory hammer/extractor 10 includes an isolation support assembly 28 for isolating the vibrations generated by the rotating eccentrics 80 from the flexible cable 20 or other supporting device used for supporting the hammer/extractor. The isolation support assembly includes a relatively heavy central support leg 108 formed from a thick heavy metal plate and provided with a circular aperture 108*a* in an upwardly extending tang portion to accomodate a cable loop of the support cable 20 which is passed through the opening 108*a* thereby to support the combined weight of the hammer/extractor 10 and the piling 24 clamped thereto when necessary.

The central support element 108 is interconnected to the upstanding leg portions 68 and 70 of the gear case 64 of the vibratory exciter 30 by a pair of shock mount elements 110 or shear fenders, each having a large rectangular body of resilient material such as rubber or synthetic rubber with opposite vertical faces vulcanized or otherwise adhesively secured to metal mounting plates 112. These plates are generally rectangular in shape and are larger than the main body cross-section of the resilient rubber body portion of the shear fenders. The outermost rectangular mounting plates 112 are secured to the inside surfaces of the respective upstanding legs 68 and 70 by cap screws 114 and through bolts 116 are provided to secure the inside mounting plates 112 to the opposite sides of the central element 108. The body of resilient material in each shock mount 110 is operative to dampen force vibrations which would otherwise be transmitted to the cable 20 from the vibratory exciter 30 during rotation of the eccentrics 80 and accordingly, this vibratory energy is available for transmission through the clamping assembly 32 to the piling or shoring element 24 clamped thereby.

As illustrated in FIG. 3, in order to prevent inadvertent disconnection of the hydraulic or electrical lines from the bundle of lines 14 and the operating components of the vibratory hammer/extractor 10 when the hammer is moved or during operation, there is provided a support bracket assembly 118 mounted on the upstanding leg 70 of the U-shaped case member 66. A pivot rod 120 is interconnected to the lever arm of the bracket assembly for supporting a collar 122 at the lower end. The bundle of lines 14 passes through the collar and is restrained thereby. In addition, the motor guard element of relatively heavy plate material 126 protects and partially encloses the hydraulic motor 94 and its supply lines during manipulation of the vibrator hammer/extractor 10 and while the hammer is in operation.

Although the present invention has been described in connection with details of the preferred embodiment, many alterations and modifications may be made without departing from the invention. Accordingly, it is intended that all such alterations and modifications be considered within the spirit and scope of the invention as defined in the appended claims.

What is claimed is:

1. A vibratory hammer/extractor for use with elongated pilings and the like, extended into the earth comprising:

a clamping assembly for selectively releasing and securing said hammer to an upper end portion of a piling to be extended into the earth;

a vibratory exciter mounted on said clamping assembly for generating vibratory forces to be imparted through said clamping assembly to said piling while clamped by said clamping assembly;

a suspension device for supporting said exciter and isolating the vibration thereof from hammer supporting means;

said exciter including a hollow case having a lower end portion secured to said clamping assembly and at least one eccentric mounted on shaft means therein for rotation about an axis transversely of said clamped piling for imparting vibratory forces thereto through said clamping assembly upon rotation of said shaft means, said eccentric comprising a unitary body of dense material having a generally circular periphery and coaxially mounted on said shaft, said body having a slot formed on one side between said shaft means and an outer rim portion adjacent said periphery thereby creating an eccentric center of gravity on an opposite side of said shaft means from said slot;

said hollow case comprising a top wall, a pair of spaced apart, relatively thick, opposite side plates having openings therein for support of said shaft means at a level spaced above lower edges of said side plates, and a relatively thin, U-shaped wall member integrally forming a pair of opposite end walls and a bottom wall and extending transversely between said side plates, said bottom wall of said U-shaped wall member positioned below and supporting said side plates at a level spaced below said shaft means, and said integral end walls of said U-shaped wall member having upper end portions projecting upwardly of said top wall;

said clamping assembly including an upper mounting plate secured adjacent said bottom wall of said U-shaped member and threaded cap screw means projecting upwardly of said mounting plate and said bottom wall into elongated threaded engagement within upwardly extending, threaded bores provided in said relatively thick side plates for securing and retaining said hollow case and said clamping assembly together while vibratory forces are generated by said exiter and for transmitting said forces from said side plates to said clamping assembly and piling;

said suspension device comprising a depending support element extending downwardly and centrally positioned between said integral end walls of said U-shaped wall member and having an upper end adapted to be connected to said hammer supporting means, and resilient, vibration isolation means supportively interconnecting opposite faces of said support element and said upper end portions of said end walls of said U-shaped wall member for isolating said support element from the vibration of said exciter; and said exciter including motor means on said case for directly rotating said shaft means.

2. The vibratory hammer/extractor of claim 1, including:

a plurality of said eccentrics mounted on spaced apart shafts supported for rotation from said exciter case; and at least one pair of said eccentrics having outer peripheral surfaces in contacting engagement for driving one eccentric from the other.

3. The vibratory hammer/extractor of claim 2, wherein:

said motor means is mounted externally on said hollow case and is in directly driving engagement with one of said shafts.

4. The vibratory hammer/extractor of claim 2, wherein:

said outer peripheral surfaces of said one pair of eccentrics comprises a pair of intermeshing gear teeth means formed on each of said eccentrics.

5. The vibratory hammer/extractor of claim 4, wherein:

each of said eccentrics includes spaced apart opposite side faces extending radially outwardly of a respective shaft, and wherein said gear teeth means extend from one side face to the other on each eccentric.

6. The vibratory hammer/extractor of claim 5, wherein:

each of said eccentrics is formed with an annular hub around said shaft and an annular rim spaced inwardly of said gear teeth means spaced outwardly around said hub; and wherein said slots comprise an opening extending between opposite side faces between said hub and rim on one side of a diametric line transversely intersecting said axis of shaft rotation.

7. The vibratory hammer/extractor of claim 6, wherein:

said slot in each of said eccentrics comprises an opening substantially encompassing all the space between said hub and rim of said one side of said diametric line.

8. The vibratory hammer/extractor of claim 1, wherein:

said relatively thick side plates are formed with one or more pairs of said openings axially aligned for said shaft means.

9. The vibratory hammer/extractor of claim 9, including:

annular bearings secured in said openings and supporting said shaft for rotation about said transverse axis spaced above said bottom wall of said hollow case.

10. The vibratory hammer/extractor of claim 9, wherein:

said shaft projects outwardly of one of said side plates and the bearing supported therein for direct connection to said motor means mounted on said side plate outside said case.

11. The vibratory hammer/extractor of claim 10, wherein:

said motor means includes a variable speed hydraulic motor.

12. The vibratory hammer/extractor of claim 1, wherein:

13. The vibratory hammer/extractor of claim 1, wherein:

said vibration isolation means comprises a plurality of resilient members secured to said opposite faces of said support element and including outer end portions secured to facing inside surfaces of said respective upper end portions of said end walls of said U-shaped member.

14. The vibratory hammer/extractor of claim 13, wherein:

said top wall extends between said facing inside surfaces of said upper end portion of said U-shaped wall member at a level below the upper ends thereof.

15. The vibratory hammer/extractor of claim 14, wherein: said top wall is joined to upper ends of said side plates.

16. The vibratory hammer/extractor of claim 15, wherein said spaced apart shafts of said eccentrics are disposed below said support element and away from said opposite faces thereof.

* * * * *

UNITED STATES PATENT AND TRADEMARK OFFICE

CERTIFICATE OF CORRECTION

PATENT NO. : 4,819,740

DATED : April 11, 1989

INVENTOR(S) : DON C. WARRINGTON

It is certified that error appears in the above-identified patent and that said Letters Patent is hereby corrected as shown below:

Col. 8, line 60, after "wherein" insert the following:

-- said U-shaped wall member has a wall thickness substantially less than that of said side plates. --

Signed and Sealed this

Twenty-second Day of September, 1992

*Attest:*

DOUGLAS B. COMER

*Attesting Officer*

*Acting Commissioner of Patents and Trademarks*